United States Patent [19]

Leggett

[11] Patent Number: 4,460,519

[45] Date of Patent: Jul. 17, 1984

[54] HYDROTHERAPY JET UNIT

[76] Inventor: Wilbur P. Leggett, 2189 Geronimo Way, Las Vegas, Nev. 89109

[21] Appl. No.: 458,438

[22] Filed: Jan. 17, 1983

Related U.S. Application Data

[63] Continuation of Ser. No. 249,892, Apr. 3, 1981, Pat. No. 4,379,097.

[51] Int. Cl.[3] ..... B01F 3/04

[52] U.S. Cl. ..... 261/76; 4/542; 128/66; 239/428.5; 261/78 A; 261/DIG. 75

[58] Field of Search ..... 261/76, 78 A, DIG. 75; 4/542; 128/66; 239/428.5

[56] References Cited

U.S. PATENT DOCUMENTS

| | | | |
|---|---|---|---|
| 1,491,057 | 4/1924 | Myers | 261/DIG. 75 |
| 1,526,179 | 2/1925 | Parr et al. | 261/DIG. 75 |
| 3,890,655 | 6/1975 | Mathis | 261/DIG. 75 |
| 3,890,656 | 6/1975 | Mathis | 261/DIG. 75 |
| 3,946,449 | 3/1976 | Mathis | 261/DIG. 75 |
| 4,041,981 | 8/1977 | Davis et al. | 261/78 A X |
| 4,112,025 | 9/1978 | Wilson et al. | 261/DIG. 75 |
| 4,221,336 | 9/1980 | Diamond | 261/DIG. 75 |
| 4,261,347 | 4/1981 | Spencer et al. | 261/DIG. 75 |
| 4,262,371 | 4/1981 | Berry et al. | 261/DIG. 75 |
| 4,264,039 | 4/1981 | Moreland | 261/DIG. 75 |

*Primary Examiner*—Richard L. Chiesa
*Attorney, Agent, or Firm*—Seiler, Quirk & Tratos

[57] ABSTRACT

A hydrotherapy jet unit used singly or in multiples for jetting pressurized water and air under submerged conditions into a water-bearing vessel, and provided with a means to fix the direction of jetted flow at an optimum angle not susceptible to change or alteration by the vessel user; however, each unit being readily adaptable to provide directional jetted flows at differing fixed angles by means of removable and interchangeable deflection nozzles. The unit features both water and air supply pipes entering the hydrotherapy jet housing at its rear extremity, said pipes being substantially parallel to each other and axially aligned with the jet action produced within the unit. This arrangement provides a means for simple removal and replacement of the unit if required without need to damage, alter or reconfigure pipe means supplying either water or air. An additional feature is an integral and functional cover cap for the frontal or exit end of the unit which is easily removable and interchangeable, and which affords a means for aesthetic change of unit external appearance whenever differing colors of finishes are desired by the user.

3 Claims, 7 Drawing Figures

FIGURE 1.
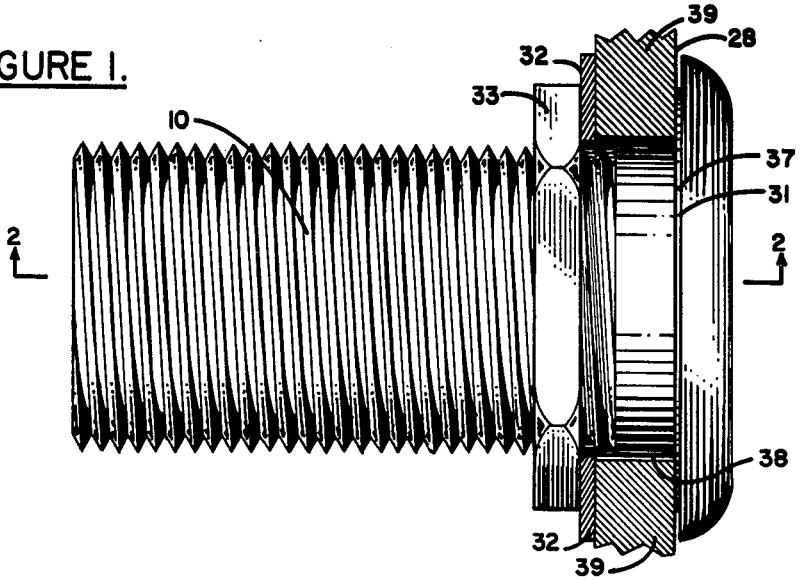
FIGURE 2.
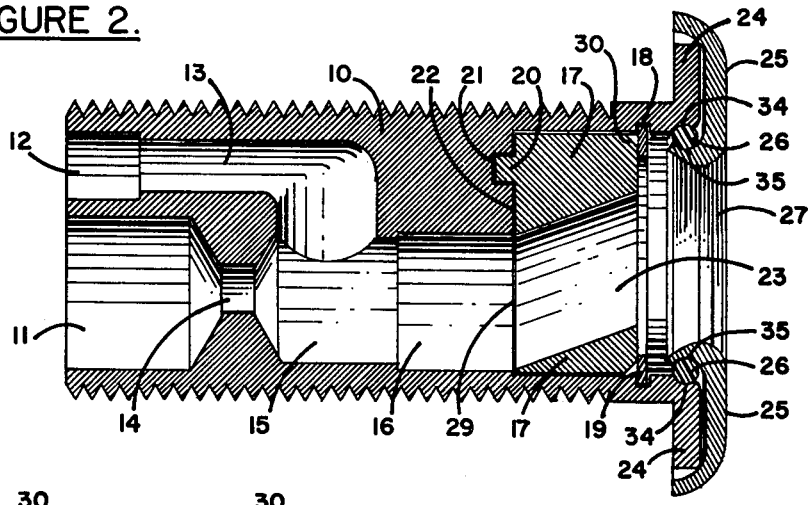
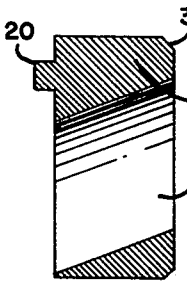
FIG. 3
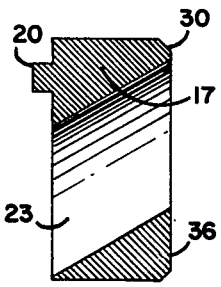
FIG. 4
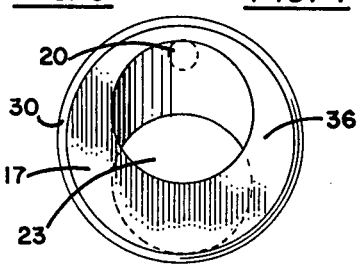
FIG. 5
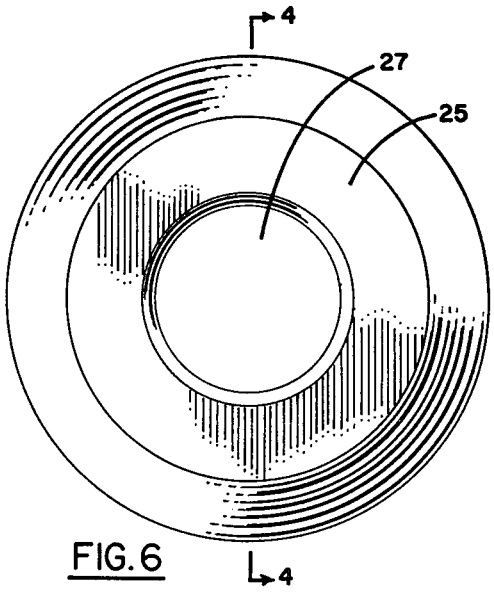
FIG. 6
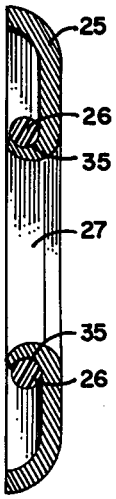
FIG. 7

HYDROTHERAPY JET UNIT

This application is a continuation of application Ser. No. 249,892, filed Apr. 3, 1981, now U.S. Pat. No. 4,379,097, entitled Hydrotherapy Jet Unit.

BACKGROUND OF THE INVENTION

The invention relates to hydromassage or therapy jet devices, and more particularly to an improved device of this type for use in water-bearing vessels, such as bathtubs, therapy tanks and pools, and the like.

A number of hydrotherapy jet units and devices are on the market at the present time, both of simple and complex designs. None, however, offer a means whereby the hydrotherapy jet unit may be removed form the tub or tank installation without substantially cutting or altering either or both the water and air pipes connected to the unit.

Many existing hydrotherapy jets units which offer a means for deflecting the hydromassage jet stream to directions other than substantially axially from the plane of jet flow and perpendicular to the wall of the vessel possess the disadvantage that portions of the body of the directional outlet member are disposed in the path of water flow. This outlet member thus tends to block the flow of outgoing water and create undesirable turbulence in the area of the entrance to the directional outlet member.

While many existing hydrotherapy jet unit outlets do not protrude substantially into the vessel and thus pose no significant risk of accident or injury to the user, none appear to offer the additional advantage of an easily removable and replaceable cover cap or escutcheon without disturbing the watertight seal of the unit in the wall of the vessel.

SUMMARY OF THE INVENTION

The present invention provides a hydrotherapy jet unit which is an improvement over the prior art.

It is an object of the invention to provide a hydrotherapy jet unit which can be quickly and easily installed through a single circular hole drilled or otherwise cut through the wall of a water-bearing vessel without special tools or devices.

It is a corollary object of the invention to provide a hydrotherapy jet unit which, when installed and subsequently fitted with pipes supplying water and air for operation of the unit, may be removed from the vessel, if required, by essentially a reversal of the installation procedure without disturbing the location or configuration of attaching water and air pipes; thus permitting simple reinstallation of a replacement jet unit without reconfiguring water and air pipes.

It is a further object of the invention to provide a hydrotherapy jet unit which offers a fixed direction of jet flow into the vessel which is achieved by use of a deflection nozzle device. Study of the prior art reveals that a number of hydromassage jet devices have claimed use of a deflection means to divert the jet flow to directions other than axially to the flow path of the water-air mixture at its point of origin within the device. Such claims pursue the concept that such a deflecting device be adjustable at the option of the user, thus permitting said user to adjust the flow direction vis a vis the adjacent interior wall of the vessel to suit a particular desire. It is herein emphasized that the deflection nozzle device incorporated in the design of my hydrotherapy jet unit differs substantially from the prior art in that it deflects the path of jetted water and air in a fixed angular direction, not readily subject to modification or change by the user. Such deflection which may result in a non-axial direction of jet flow is determined when the hydrotherapy jet unit, perhaps in combination with other hydrotherapy jet units of the same type, is installed in the vessel of intended use. Such direction of jet flow is optimized to achieve a pattern of agitated water movement intended to result in the most efficient hydromassage effect possible upon the body of the user without producing an undesirable roiling or vortexing motion of the whole body of water in the vessel.

It is an additional object of the invention to provide a means whereby the body of the hydrotherapy jet unit when fitted with a deflection nozzle to achieve a fixed direction of jet flow may be easily and quickly refitted with a different deflection nozzle to achieve a greater or lesser fixed deflection of jet flow, depending upon the angular bore of the deflection nozzle selected. Thus, a single-design jet body can be readily adapted to a wide variety of fixed directions of jet flow with respect to the axial plane of the jet body by the installation of the proper deflection nozzle.

Another object of the invention is to provide a hydrotherapy jet unit which, after fully completed installation in the vessel, can be substantially altered in aesthetic appearance by the easy removal and replacement of the outer and visible functional escutcheon or cover cap by another of like design and proportions bearing a different surface finish. Such cover cap change can be effected with no upset whatsoever to the watertight seal of the jet unit in the vessel. When, in the preferred embodiment of the invention, this cover cap is fabricated of metal, the aesthetic change is normally the result of either a different metal or, more particularly, a different electroplating finish on the surface of a single metal. Advantages of this feature include but are not limited to:

(a) A dealer offering tubs or tanks fitted with the hydrotherapy jet units can stock a limited and economical number of such tubs while affording his customers the flexibility of selecting from a wide range of metal finishes to harmonize with or match existing bathroom hardware. Random examples of popular finishes are: polished chromium, satin brass, simulated pewter, antique brass, polished gold, et cetera.

(b) After installation of the tub containing the hydrotherapy jet units in the user's location, should the finish on the cover caps be worn, marred or defaced so as to be aesthetically displeasing, the cover caps may be easily removed for replating or for replacement with like items to restore original appearance.

The invention also comprises such other objects, advantages and capabilities as will later appear more fully and which are inherently possessed by the invention.

While there is shown in the accompanying drawings a preferred embodiment of the invention, it should be understood that the same is susceptible of modification and change without departing from the spirit of the invention.

DESCRIPTION OF THE DRAWINGS

The invention is best understood with reference to the drawings, in which:

FIG. 1 is a side elevation view of the hydrotherapy jet installed in a vessel;

FIG. 2 is a top longitudinal sectional view of the same, taken on line 2—2 of FIG. 1;

FIG. 3 is a top longitudinal sectional view of the deflection nozzle;

FIG. 4 is a top longitudinal sectional view of a similar deflection nozzle illustrating a differing angular bore;

FIG. 5 is a front view of the deflection nozzle shown in FIG. 4;

FIG. 6 is a front plan view of the cover cap; and

FIG. 7 is a side sectional view of the cover cap on line 4—4 of FIG. 6.

DESCRIPTION OF THE PREFERRED EMBODIMENT

A preferred embodiment which has been selected to illustrate my invention comprises a jet body member or housing 10, which is formed normally, although not exclusively, of a non-ferrous metal such as brass. The jet body 10 is provided with a thin flat circular gasket/-washer 31 through which is inserted jet body 10 and which, when coated with suitable sealing material (such as, but not limited to, silicone sealant) is placed against rear shoulder of mounting flange 24 in the position as indicated at 37. When jet body 10 is then inserted through a circular hole 38 of proper diameter which has been drilled or otherwise cut through and substantially perpendicular to the interior surface of wall 28 of tub or tank 39, a flat washer 32 is slipped down the cylindrical male-threaded exterior barrel of jet body 10 and a locking-type hex nut 33 (or other suitable substitute nut) is secured tightly by conventional wrench or plier means against the flat washer 32, the jet body 10 is thus securely affixed through the wall of the tub or tank in a manner so as to insure a permanent watertight seal of the hydrotherapy jet unit in the vessel.

A water inlet opening 11 is provided at the rear of jet body 10 eccentrically located and substantially parallel with respect to the longitudinal axis of jet body 10. This opening is of such diameter and depth as to receive standard-sized pipe or pipe fittings which are fabricated of a compatible material; e.g., copper fittings for a brass-fabricated jet body or polyvinyl chloride fittings for a polyvinyl chloride-fabricated jet body, et cetera. An air inlet opening 12 is provided also at the rear of jet body 10 eccentrically located and substantially parallel with respect to the longitudinal axis of jet body 10 and to water inlet opening 11. The air inlet opening 12 is, in the same manner and for the same reasons, sized with respect to diameter and depth to receive standard pipe or pipe fittings fabricated of a compatible material. In the preferable fabrication of jet body 10 of brass metal, the securing of water and air supply pipes through openings 11 and 12 respectively are by the means of soldering. When the jet body 10 has been installed as described and water and air pipes have been affixed by soldering or otherwise at 11 and 12 respectively, should need arise to remove the jet body for any reason whatsoever, an exact sequential reversal of the total installation procedure can easily be effected with no upset whatsoever to disposition of plumbing means provided to supply water and air to the jet body 10. Re-installation of the same or another like jet body will require a reaccomplishment of the original procedure.

Immediately forward of the water inlet opening 11, oriented in axial alignment, is the jet orifice 14, which exits into the water-air mixing chamber 15.

Forward of the air inlet opening 12 is provided a plenum cavity 13, which ducts air axially forward to a point immediately abeam of the jet orifice 14, at which point the plenum cavity 13 abrubtly, although smoothly so as to avoid creating undesirable air turbulence, turns substantially ninety degrees (90°) inward toward the axis of the jet body 10 and enters the water-air mixing chamber 15 at a point immediately forward of the water exit opening of the jet orifice 14.

Forward of the water-air mixing chamber 15, also aligned axially to the jet body 10, is the expansion chamber 16, the function of which will be described subsequently. Further forward of the expansion chamber 16 is the deflection nozzle cavity 22 into which has been fitted a deflection nozzle 17.

The concept of a deflection nozzle or like device may be found in the prior art. However, the deflection nozzle serves not only the previously defined purpose of deflecting the jet flow to a position other than perpendicular to the tub or tank wall, but also as a primary function ducts the jet flow from a channel 15 and 16 eccentrically removed from, yet substantially parallel to the longitudinal axis of jet body 10, and directing it inward substantially toward that longitudinal axis so as to dispose the jet flow more nearly to the center of the cover cap opening 27, thence through that opening 27.

The purpose of the deflection nozzle 17 is to receive the water-air mixture as it emerges from the cylindrical channel formed by the water-air mixing chamber 15 and expansion chamber 16 (both of which are eccentrically bored with respect to the longitudinal axis of jet body 10 yet are substantially parallel to that axis), and directionally orienting the water-air jetted mixture forward and ultimately into the tub or tank at the desired angle. This desired angle is the angular deflection of the jet from a point perpendicular to the interior wall of the tub or tank 28 and can be normally accomplished over a lateral arc of approximately thirty-two degrees (32°) from the wall-perpendicular with no significant degradation of performance or jet intensity. This lateral deflection is achieved solely by the angle of bore of the channel 23 through the deflection nozzle 17 expressed as a lateral angular departure from the longitudinal axis of the deflection nozzle 17 as displaced to a line substantially parallel to that longitudinal axis, but eccentrically offset to coincide with the center of nozzle bore 23 at its rear entry point 29.

The deflection nozzle 17 is oriented during installation in the jet body 10 by means of an integral centering pin 20 in the deflection nozzle 17 which drops into pin cavity 21 bored into the rear wall of cavity 22 at a point near the perimeter of cavity 22 and opposite the bore of the channel formed by chambers 15 and 16 on an extended line passing through the longitudinal axes of the expansion chamber 16 and the jet body 10. The angular bore 23 of the deflection nozzle 17, which is accomplished commencing at the rear of the deflection nozzle 17, then drilling forward along a deflected axial line, is located with respect to centering pin 20 so that when the deflection nozzle 17 is rotationally placed so that pin 20 fits into cavity 21 the angular bore 23 of deflection nozzle 17 aligns accurately with the exit point of expansion chamber 16 thus to dispose no obstructing portion of deflection nozzle 17 into the jet flow to create an undesirable turbulence within that jet flow.

The deflection nozzle 17, when seated into position with centering pin 20 in pin cavity 21, is secured in the following manner: An annular groove 18 is provided in the perimeter wall of deflection nozzle cavity 22 immediately at the frontal face of deflection nozzle 17. A non-ferrous metal internal retaining snap ring 19 is inserted into groove 18 utilizing a common internal snap ring insertion and removal tool. The frontal perimeter shoulder of deflection nozzle 17 is provided with a substantially forty-five degree (45°) bevel. This bevel in conjunction with the spring-tension nature of the internal snap ring 19 assures a snug seating of the deflection nozzle 17 in its cavity 22 not subject to vibration or other movement induced by the dynamic motion of the water-air mixture through angular bore 23. Removal of the deflection nozzle 17 for service or replacement with a like nozzle having a different angular bore 23 is accomplished simply by using a snap ring insertion and removal tool to remove snap ring 19, thence drawing deflection nozzle 17 forward and out of cavity 22.

Approaching the forward extremity of the deflection nozzle cavity 22, and abeam of the mounting flange 24, an annular ring retaining groove 34 is provided in the perimeter wall of the deflection nozzle cavity 22. The bottom and sides of this ring retaining groove 34 are, in cross-section, shaped in an arc which is radiused to the proper dimensions to receive and seat snugly against the outer diameter of an "O" ring 26 which is normally but not exclusively fabricated of neoprene material (other materials possessing substantially similar properties are equally acceptable).

A circular shaped cover cap 25 is provided which features an annular ring 35, radiused to the same cross-sectional arc dimensions as retaining ring groove 34, so as to receive and seat snugly against the inner diameter of "O" ring 26. The wall of the cover cap 25 inward toward the longitudinal axis of cover cap 25 from annular ring 35 is of even thickness, and the outer surface of said wall is radiused for the same arc axis (which is, in fact, the cross-sectional axis of "O" ring 26 when said ring is in its functional position) so as to provide a smoothly rounded cross-sectional perimeter surface of cover cap opening 27. As the result of this design, the cover cap opening 27 functions to provide the final definition for the jet flow as it exits from the hydrotherapy jet unit and into the tub or tank.

Diametrically outward from the cover cap opening 27 to the outer perimeter of cover cap 25, the cover cap 25 is cross-sectionally shaped to function as a cover for mounting flange 24, and, beyond the outer perimeter of said flange 24, the cover cap shape turns rearward in a gently radiused cross-sectional arc toward the inward wall surface 28 of tub or tank, thereby obscuring the otherwise potentially hazardous forward perimeter shoulder of mounting flange 24. The outer perimeter of cover cap 25 terminates at a point snugly against the tub wall surface 28 in substantially the identical linear plane of the rear or tub-wall-contact shoulder of mounting flange 24. Thus the cover cap 25, while serving aesthetically as a frontal escutcheon for the hydrotherapy jet unit, also and more particularly functions as a smooth-surfaced member protruding only slightly into the tub or tank and posing virtually no risk factor for possible accident or injury to the user.

Cover cap 25 is not normally installed in its intended location until after the jet body 10 has been firmly secured in the wall 28 of the tub or tank as previously described. This delay in cover cap 25 installation facilitates the removal of excess sealant from the wall-mating-side perimeter of mounting flange 24 and a more accurate inspection of the watertight seal of the jet body 10 in the tub or tank. Thereafter the cover cap 25 is installed simply and easily with no required tools by placing the "O" ring 26 in the cover cap annular ring 35; then, while holding this cap 25 and ring 26 sub-assembly at an approximate fifteen degree (15°) angle outward from the plane of the tub wall 28 and inserting the sub-assembly into the receiving annular ring groove 34 at that point where the cap 25 and ring 26 sub-assembly are closest to the jet body 10 (by virtue of the 15° angle at which the sub-assembly is being held), thus seating the "O" ring 26 snugly into its receiving annular groove 34, exert thumb or finger pressure applied at the cover cap opening 27 perimeter wall so as to compress the resilient "O" ring 26 material at the annular groove 34 seating point while simultaneously pressing the diametrically opposite side of the cover cap 25 against the tub wall surface 28 and forcing the cap sub-assembly 25 and 26 to rotate slightly in either a clockwise or counter-clockwise manner. This procedure will cause the "O" ring 26 to dispose itself smoothly and readily into annular groove 34, thus seating properly and snugly throughout the entire circumferential contact area of ring 26 and groove 34. A nominally permanent installation of cover cap 25 is thus achieved. Removal of the cover cap 25 is more easily achieved by inserting the flat end of a common screwdriver through cover cap opening 27, resting a lateral face of the flat screwdriver against the inward or back side of cover cap 25 at any point around the rear perimeter of annular groove 35; then while utilizing the frontal face of cover cap 25 as a fulcrum at a point diametrically opposed across cap opening 27 from the contact point of screwdriver with rear side of cover cap 25 inner perimeter, depress the handle of the screwdriver toward the tub wall 28. This action will overcome the retaining tension of "O" ring 26 acting within grooves 34 and 35 and the cover cap 25 will thus be detached from the jet body 10 affording a means to change the cover cap 25.

In an operating condition, water is introduced into the jet body 10 from a pressurizing source, such as an electrically driven pump means through a combination of pipe and pipe fitting means to the water inlet opening 11. Ambient air from above the water level is available to the hydrotherapy jet unit via pipe means and pipe fitting means, and is introduced into the jet body 10 through the air inlet opening 12. As presurized water enters water inlet 11, it moves forward rapidly increasing in linear velocity as it is constricted through jet orifice 14 whereupon pressure decreases, and, as the water continues its forward movement to the exit point from jet orifice 14, the reduced pressure created by the velocity of water emerging from the jet orifice 14 produces a venturi effect, drawing ambient air through plumbing means to air inlet opening 12, thence to plenum cavity 13, thence into the water-air mixing chamber 15.

The water-air mixture continues forward axially into expansion chamber 16 at an augmented velocity resulting from the introduction of air into the mixture. Passage of the mixture through the expansion chamber 16 permits a more homogeneous mixing of the water-air components and initially defines their subsequent direction and pattern of movement. Entering the rear of the deflection nozzle 17 through its cylindrical bore 23 without blocking disturbance of any kind, the mixture is deflected laterally in accordance with the angular bore 23 through the deflection nozzle 17, at which point the ultimate directional flow of the jetted mixture is determined. Final definition of the diameter and concentration of the jetted mixture occurs when it passes through the circular opening 27 of cover cap 25, thence into the tub or tank producing a jet pattern of diminished conical divergence and resulting in the disposition of a more forceful hydromassage action upon the user than would otherwise be achieved.

While the invention has been described with respect to a preferred embodiment thereof, many modifications and changes are possible within the spirit and scope of the invention and will be apparent to those skilled in the art. Therefore, the invention should not be considered limited by the foregoing description, but rather should be defined only by the following claims.

I claim:

1. A hydrotherapy jet unit comprising a housing having a water inlet and an air inlet at a rear portion thereof, said water and air inlets being substantially coplanar, and a mixed fluid outlet at a forward portion thereof, said jet unit also comprising a mixing chamber, a longitudinal water passageway extending forwardly from the water inlet to the mixing chamber, and an air passageway extending from the air inlet to the mixing chamber, said air passageway having a rearward portion parallel to the water inlet and an angled foreward portion extending to the mixing chamber said housing having an elongate cylindrical rear body portion extending to the rearward extremity of the housing having a substantially uniform diameter and having exterior threads along substantially the entire length of the housing.

2. A hydrotherapy jet unit comprising a cylindrical housing having a threaded exterior surface portion, air and water inlets at a rear portion thereof and a mixed fluid outlet formed by a wall of a cylindrical bore in the housing at a forward portion thereof, a circular mounting flange extending radially from the forward portion of the housing, a detachable decorative cover cap having a central circular orifice adapted to fit over the mounting flange, said orifice being formed at least in part by inwardly converging walls adapted to provide final definition to fluid flowing through the unit, and mounting means for frictionally attaching the cover cap to the housing.

3. The unit of claim 2 wherein the mounting means comprises an O-ring mounted in an O-ring support annular to the orifice in the cover cap, and an annular groove in the wall of the cylindrical bore adapted to receive the O-ring in frictional engagement therewith.

* * * * *